US006644937B2

(12) United States Patent
Han

(10) Patent No.: US 6,644,937 B2
(45) Date of Patent: Nov. 11, 2003

(54) WATER POWERED PUMPING SYSTEM WITH FLUID LINK

(76) Inventor: Tai-Kang Han, 2F, No. 12, Lane 366, Ta-Ming Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 10/075,815

(22) Filed: Feb. 13, 2002

(65) Prior Publication Data

US 2003/0185688 A1 Oct. 2, 2003

(51) Int. Cl.[7] ..... F04B 17/00; F04B 35/02; F04B 39/00; F16D 31/02; F01D 15/00

(52) U.S. Cl. ..... 417/329; 417/383; 417/390; 417/572; 60/398; 415/916

(58) Field of Search ..... 417/383, 329, 417/390, 399, 403, 572; 60/398; 415/916

(56) References Cited

U.S. PATENT DOCUMENTS 223,777 A * 1/1880 Thiers ..... 417/329
479,291 A * 7/1892 Marsh ..... 60/640
510,983 A * 12/1893 Mellor of Mark ..... 417/329
1,207,824 A * 12/1916 Wendt ..... 417/329
1,260,204 A * 3/1918 Keithly ..... 60/640
1,782,975 A * 11/1930 Schaer ..... 417/385
2,490,118 A * 12/1949 Dickinson ..... 417/383
3,028,727 A * 4/1962 Anston ..... 60/473
4,930,993 A * 6/1990 Han et al. ..... 417/226
5,511,954 A * 4/1996 Han ..... 417/121

* cited by examiner

*Primary Examiner*—Cheryl J. Tyler
*Assistant Examiner*—Timothy P. Solak
(74) *Attorney, Agent, or Firm*—Connolly Bove Lodge & Hutz

(57) ABSTRACT

A water powered pumping system includes a leverage connected to a water source and moving upward and downward by using a water weight to produce a lever movement, a hydraulic pump pushed by the leverage to move reciprocally, and a water pump pushed by the hydraulic pump to perform a water drawing movement for drawing the water contained in a water source and conveying the water into a water storage tower.

6 Claims, 7 Drawing Sheets

WATER POWERED PUMPING SYSTEM WITH FLUID LINK

BACKGROUND OF THE INVENTION

1. Field of the Invention

The present invention relates to a water powered pumping system that can convey a water flow from a location at a lower level to any location at a higher level by using a natural power, thereby facilitating the user at a remote region using the water for purposes, such as irrigation or the like.

2. Description of the Related Art

In a remote region, such as the hill or the like, the people has to introduce the water from a location at the higher level, such as the mountain, into the location at a lower level, such as the farm, for purposes of such as irrigation, drinking or the like. in addition, the people need to use a water pump for pumping the water. However, the water pump cannot be used when lack of the electric power or the fuel. In addition, the water pump is easily worn out during long-term utilization. Further, the water pump has to be repaired by a professional technician, thereby causing inconvenience in maintenance of the water pump.

The closest prior art of which the applicant is aware is disclosed in his U.S. Pat. No. 4,930,993, entitled "ENERGY REGENERATIVE APPARATUS FOR A WATER HAMMER TYPE PUMP", and his U.S. Pat. No. 5,511,954, entitled "WATER PUMPING SYSTEM USING SOLAR ENERGY".

SUMMARY OF THE INVENTION

The primary objective of the present invention is to provide a water powered pumping system, wherein the water powered pumping system can convey a water flow from a location at a lower level to any location at a higher level by using a natural water power, thereby facilitating the user at a remote region using the water for purposes, such as irrigation or the like.

Another objective of the present invention is to provide a water powered pumping system, wherein the water powered pumping system may guide the water in any collected water source into the water container of a lever, and may use the water weight as a power source, to pump the water contained in any water source to the water storage tower, without having to use the electric power, the petroleum, the gas or the like, so as to replace the conventional motorized or gas pump, thereby saving the energy, and thereby preventing incurring any pollution.

A further objective of the present invention is to provide a water powered pumping system, wherein the water powered pumping system has a simple construction, thereby facilitating maintenance of the operator.

A further objective of the present invention is to provide a water powered pumping system, wherein the water powered pumping system may be made easily and conveniently, thereby decreasing the cost of fabrication.

A further objective of the present invention is to provide a water powered pumping system, wherein the water powered pumping system may be operated easily and conveniently, thereby facilitating the user using it.

In accordance with the present invention, there is provided a water powered pumping system, comprising:

a leverage, connected to a water source and moving upward and downward by using a water weight to produce a lever movement;

a hydraulic pump, pushed by the leverage to move reciprocally; and a water pump, pushed by the hydraulic pump to perform a water drawing movement, for drawing the water contained in the water source and conveying the water into a water storage tower.

Further benefits and advantages of the present invention will become apparent after a careful reading of the detailed description with appropriate reference to the accompanying drawings.

DETAILED DESCRIPTION OF THE INVENTION

Figure 1:
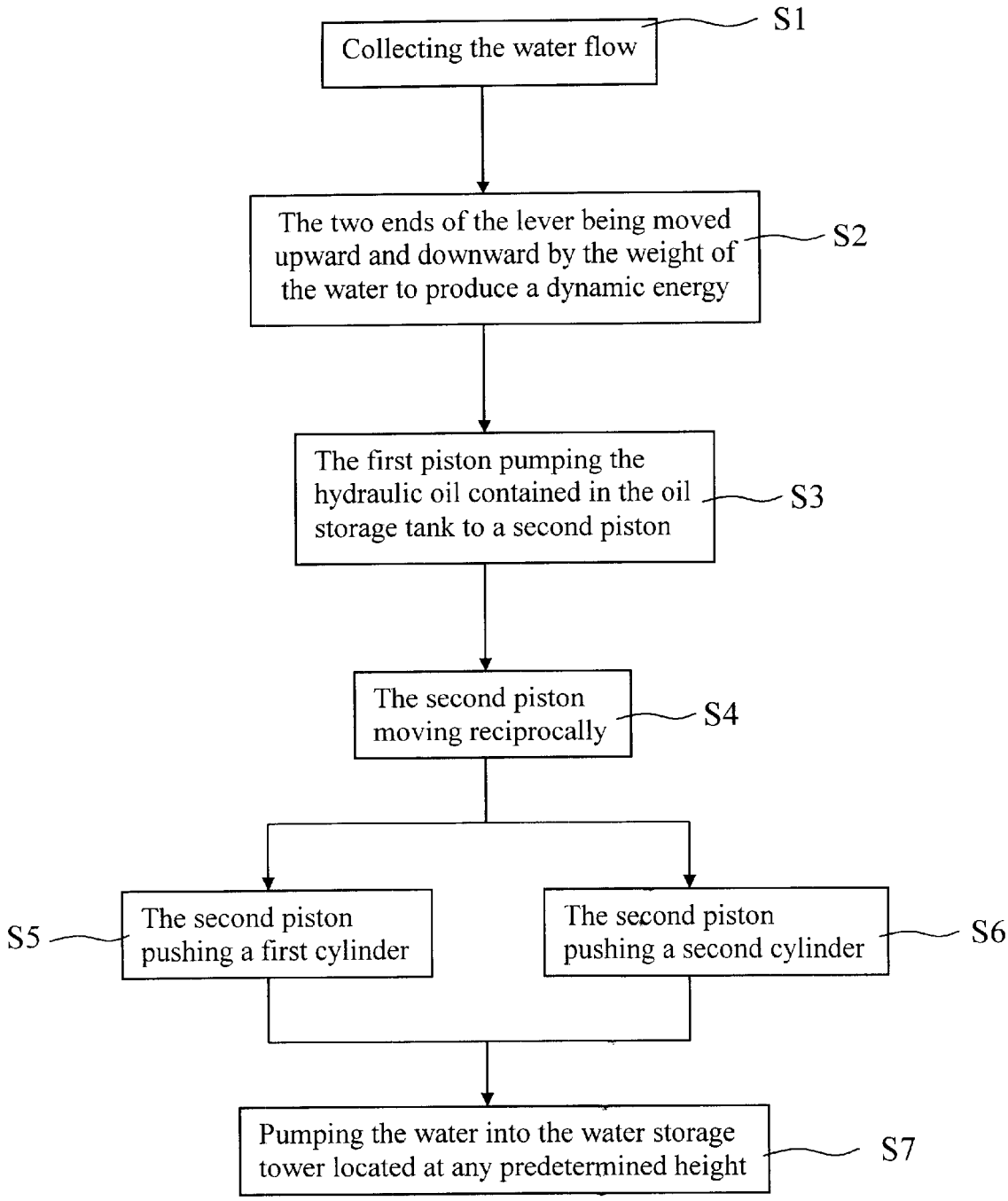
FIG. 1 is a flow chart of a water powered pumping system in accordance with the present invention.

Referring to the drawings and initially to FIG. 1, a water powered pumping system in accordance with a preferred embodiment of the present invention comprises the following steps: collecting the water flow (S1), then introducing the water into two water containers suspended on two ends of a lever, the two ends of the lever being moved upward and downward by the weight of the water to produce a dynamic energy (S2) which may push a first piston having a smaller area which may pump the hydraulic oil contained in the oil storage tank to a second piston having a larger area (S3), so that the second piston may move reciprocally (S4), and may push a first cylinder (S5) and a second cylinder simultaneously (S6), so as to perform water extraction and water pumping actions in an alternating manner, thereby pumping the water into the water storage tower located at a predetermined height (S7).

Referring to FIGS. 2–5, a water powered pumping system in accordance with a first embodiment of the present invention comprises a leverage 10 that may use the water weight of a collected water source 90 to produce a lever movement, a hydraulic pump 20 that may be pushed by the leverage 10 to move reciprocally, a water pump 30 that may be pushed by the hydraulic pump 20 to perform a water drawing movement (including water extraction and water pumping actions), for drawing the water contained in a water source 91 (such as the river) and conveying the water into a water storage tower 40, and a water distribution line 50 for conveying the water into a place, such as the farm, for irrigation.

In the water powered pumping system in accordance with a first embodiment of the present invention, the water contained in the collected water source 90 may be conveyed through a water guide pipe 61, and may be respectively introduced into a first water container 11 and a second water container 12 suspended on the two ends of the leverage 10 during a determined time interval by a flow divider 62, such as a ball valve. The water weight may force the two ends of the leverage 10 to move upward and downward at different time intervals, thereby pushing a first piston 21 having a smaller area in the hydraulic pump 20 to move reciprocally in a first hydraulic cylinder 22 having a smaller volume, there pumping the hydraulic oil to flow through a hydraulic oil line 23 to push a second piston 24 having a larger area to move in a second hydraulic cylinder 25 reciprocally. Thus, this hydraulic movement mechanism has an effect of amplifying the force.

The second piston 24 may be moved in the second hydraulic cylinder 25 linearly and reciprocally by a hydraulic oil converter 26, to push a first cylinder 31 and a second cylinder 32 of the water pump 30, so as to perform a water drawing movement, including water extraction action and water pumping action, in an alternating manner, so that the water contained in the water source 91 may be conveyed through a water drawing pipe 63, a water drawing pipe one-way valve 64, a water pumping pipe 65 and a water pumping pipe one-way valve 66 into the water storage tower 40, and a water distribution line 50 for conveying the water into a place, such as the farm, for irrigation.

The hydraulic oil line 23 between the first piston 21 and the second piston 24 includes a hydraulic oil high pressure oil pipe 231, a hydraulic oil high pressure one-way valve 232, a hydraulic oil converter 26, a hydraulic oil return pipe 233, and a hydraulic oil return one-way valve 234.

Figure 3:
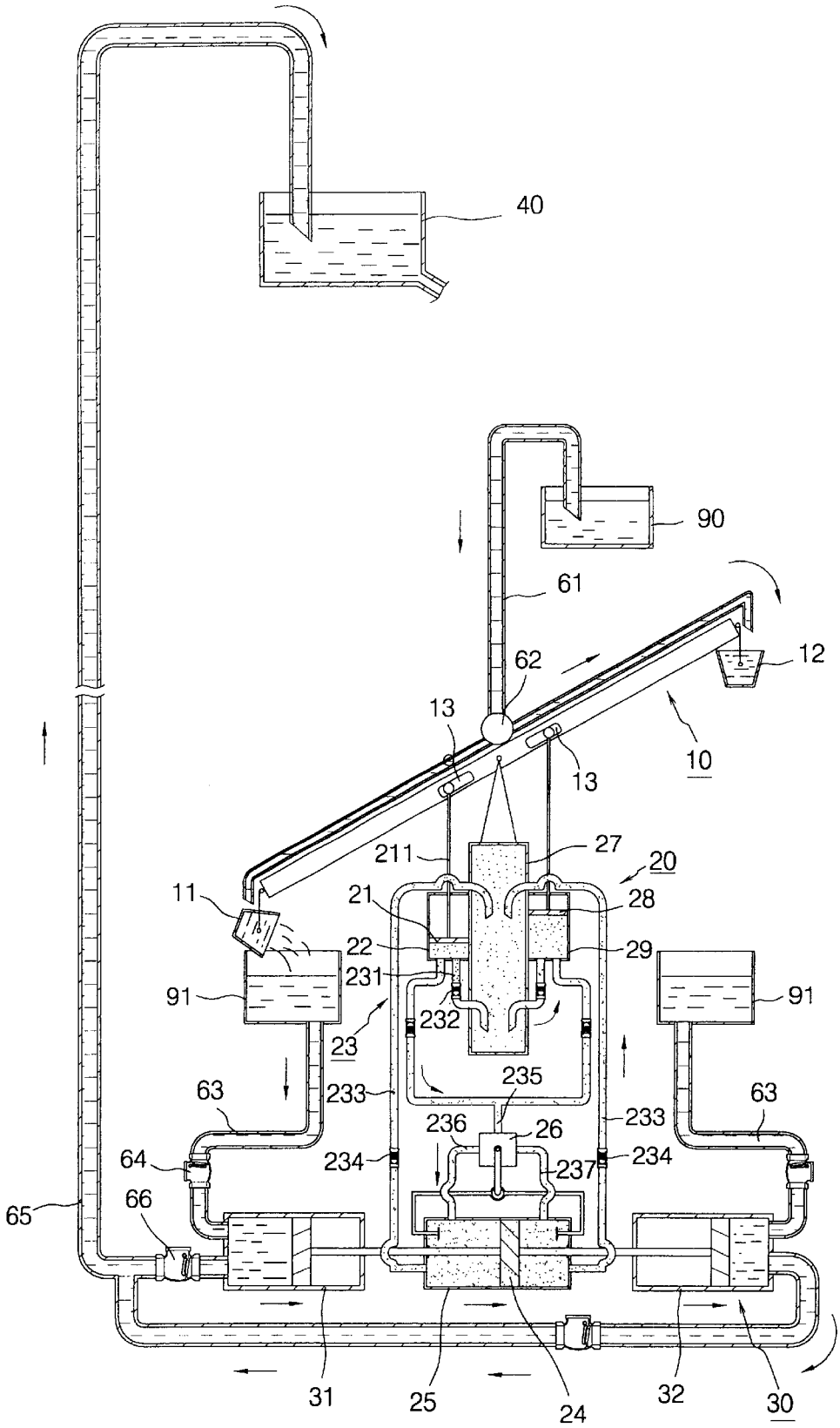
FIG. 3 is a schematic operational view of the water powered pumping system as shown in FIG. 2 in use.
Figure 4:
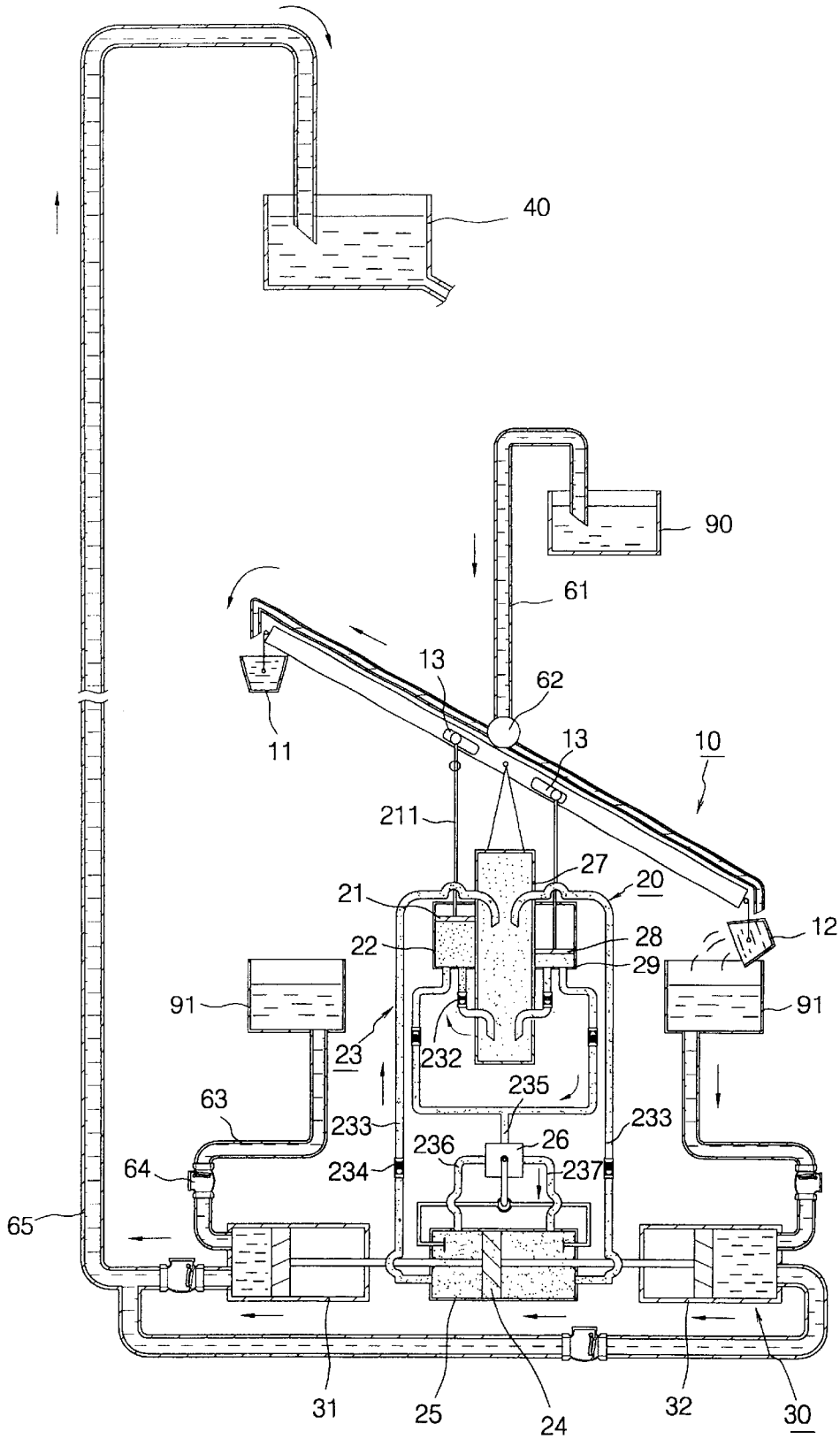
FIG. 4 is a schematic operational view of the water powered pumping system as shown in FIG. 2 in use.

As shown in FIG. 3, the leverage 10 is inclined leftward, so that the water contained in the first water container 11 may be poured into the water source 91. At the same time, the leverage 10 inclined leftward may drive the valve rod of the flow divider 62, such as a ball valve, to rotate through a determined angle to close the water path directed toward the first water container 11, and to open the water path directed toward the second water container 12, until the second water container 12 is filled with water. In such a manner, the leverage 10 may be inclined rightward as shown in FIG. 4 due to the water weight of the second water container 12. At the same time, the leverage 10 inclined rightward may drive the valve rod of the flow divider 62, such as a ball valve, to rotate through a determined angle to open the water path directed toward the first water container 11, and to close the water path directed toward the second water container 12, until the first water container 11 is filled with water. The above-mentioned procedure may be repeated, so that the leverage 10 may be inclined rightward or leftward at different time intervals.

Figure 2:
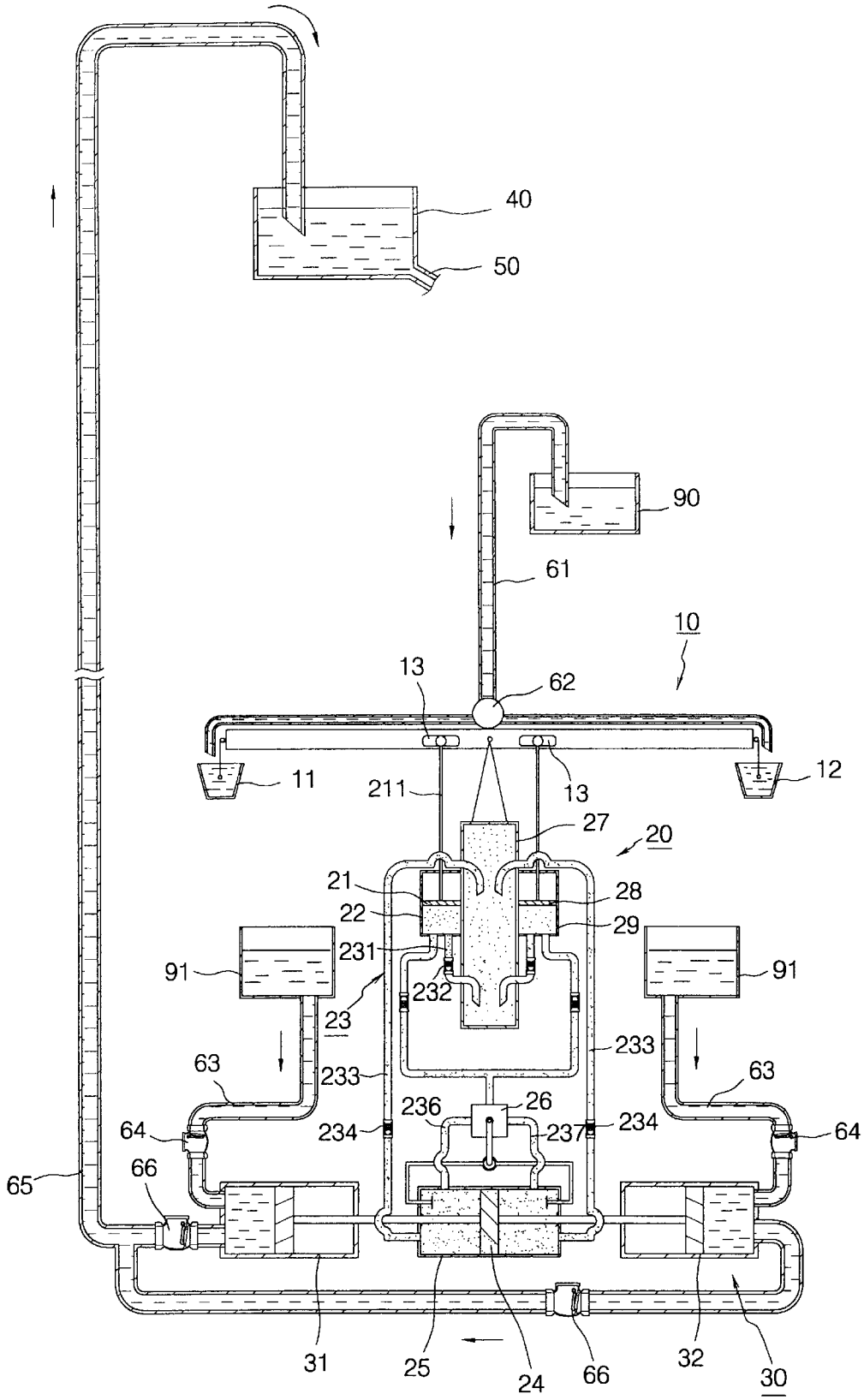
FIG. 2 is a schematic view of a water powered pumping system in accordance with a first embodiment of the present invention.
Figure 5:
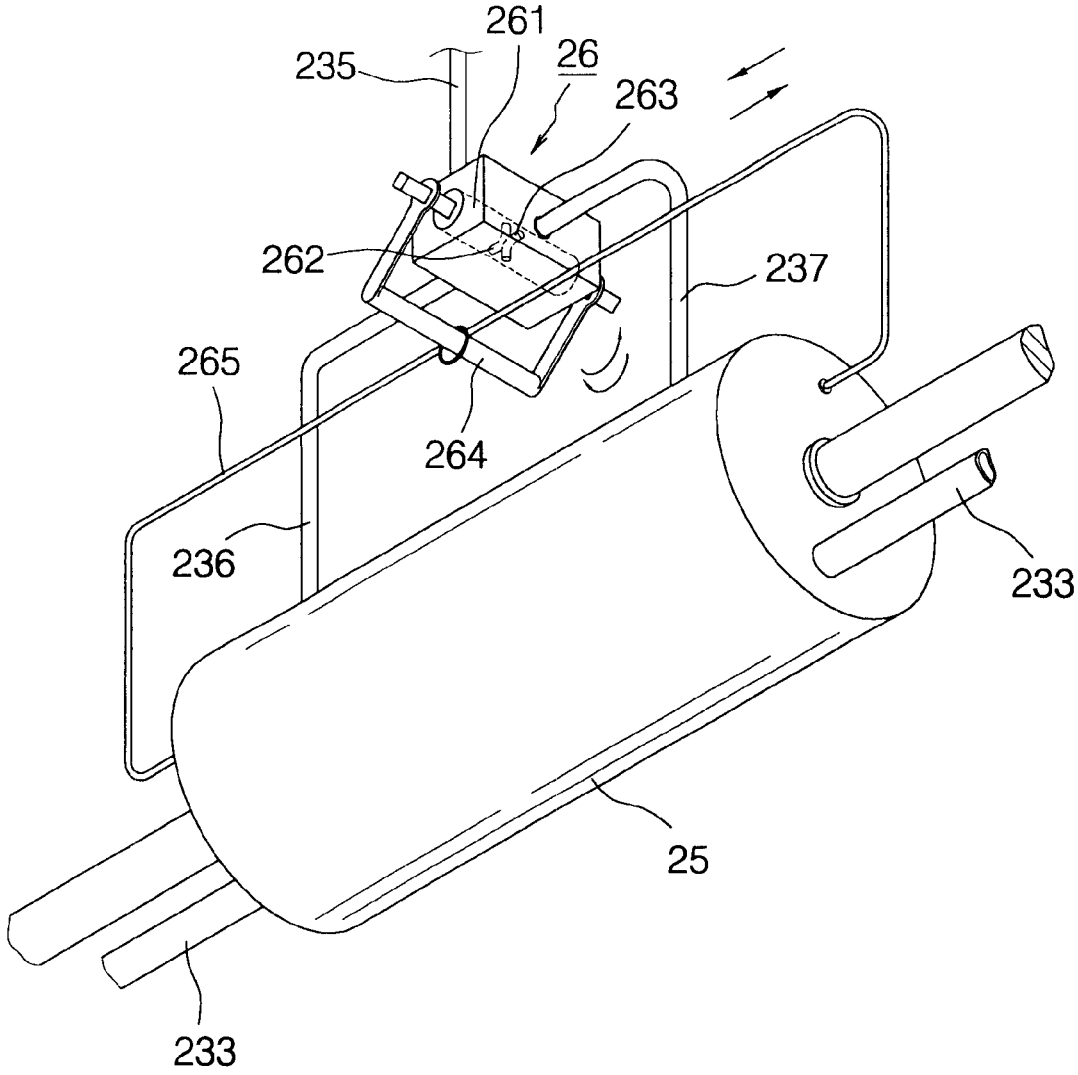
FIG. 5 is a perspective view of a hydraulic oil converter of the water powered pumping system as shown in FIG. 2.

Referring to FIGS. 2–4, when the leverage 10 is inclined leftward, the left-sided piston rod 211 pivoted in the left-sided elongated slot 13 of the leverage 10 may push the left-sided first piston 21 to move downward, to pump the hydraulic oil contained in the left-sided first hydraulic cylinder 22 through the hydraulic oil converter 26 into the left side of the second piston 24 in the second hydraulic cylinder 25. At the same time, the right-sided first piston 28 is moved upward, so that the right-sided first hydraulic cylinder 29 may suck the hydraulic oil contained in the oil storage tank 27 until reaching a saturation state. Similarly, when the leverage 10 is inclined rightward, the right-sided first piston 28 may pump the hydraulic oil contained in the right-sided first hydraulic cylinder 29 through the hydraulic oil converter 26 into the left side of the second piston 24 in the second hydraulic cylinder 25. That is, when the leverage 10 is inclined leftward or rightward, the hydraulic oil may be pumped into the left side of the second piston 24 in the second hydraulic cylinder 25, so that the second piston 24 is always moved rightward in the second hydraulic cylinder 25, until triggering the shaft center turning rod 261 of the hydraulic oil converter 26 to rotate to another oil pressure loop as shown in FIG. 5. When the shaft center turning rod 261 of the hydraulic oil converter 26 is rotated to another oil pressure loop, the hydraulic oil may be pumped into the right side of the second piston 24 in the second hydraulic cylinder 25, so that the second piston 24 is always moved leftward in the second hydraulic cylinder 25, until triggering the shaft center turning rod 261 of the hydraulic oil converter 26 to rotate to the original oil pressure loop, thereby forming a reciprocating linear movement.

When the second piston 24 is moved rightward in the second hydraulic cylinder 25, the right-sided hydraulic oil may flow through the right-sided hydraulic oil return pipe 233 and the right-sided hydraulic oil return one-way valve 234 into the oil storage tank 27. On the contrary, when the second piston 24 is moved leftward in the second hydraulic cylinder 25, the left-sided hydraulic oil may flow through the left-sided hydraulic oil return pipe 233 and the left-sided hydraulic oil return one-way valve 234 into the oil storage tank 27.

Referring to FIG. 5, the hydraulic oil converter 26 mainly includes a shaft center turning rod 261 formed with a first return hole 262 and a second return hole 263, a U-shaped rocking rod 264 mounted on the two ends of shaft center turning rod 261 for forcing the shaft center turning rod 261 to reciprocally rotate in a determined angle, and an inverted U-shaped push rod 265 connected with the rocking rod 264 for moving the rocking rod 264 synchronously. The two ends of the inverted U-shaped push rod 265 is extended into the second hydraulic cylinder 25.

Thus, when the second piston 24 is pushed by the hydraulic oil to the left side of the second hydraulic cylinder 25 to urge the left-sided end of the inverted U-shaped push rod 265, the inverted U-shaped push rod 265 may be moved leftward, and the rocking rod 264 may be moved leftward synchronously, to force the shaft center turning rod 261 to rotate through a determined angle, thereby communicating a hydraulic oil enter pipe 235 with the first return hole 262 of the shaft center turning rod 261, so that the hydraulic oil contained in the hydraulic oil enter pipe 235 may enter the left side of the second hydraulic cylinder 25 through the left-sided hydraulic oil pipe 236, thereby forcing the second piston 24 to move rightward.

Similarly, when the second piston 24 is pushed by the hydraulic oil to the right side of the second hydraulic cylinder 25 to urge the right-sided end of the inverted U-shaped push rod 265, the inverted U-shaped push rod 265 may be moved rightward, and the rocking rod 264 may be moved rightward synchronously, so as to force the shaft center turning rod 261 to rotate to the original position, thereby communicating the hydraulic oil enter pipe 235 with the second return hole 263 of the shaft center turning rod 261, so that the hydraulic oil contained in the hydraulic oil enter pipe 235 may enter the right side of the second hydraulic cylinder 25 through the right-sided hydraulic oil pipe 237, thereby forcing the second piston 24 to move leftward.

Figure 6:
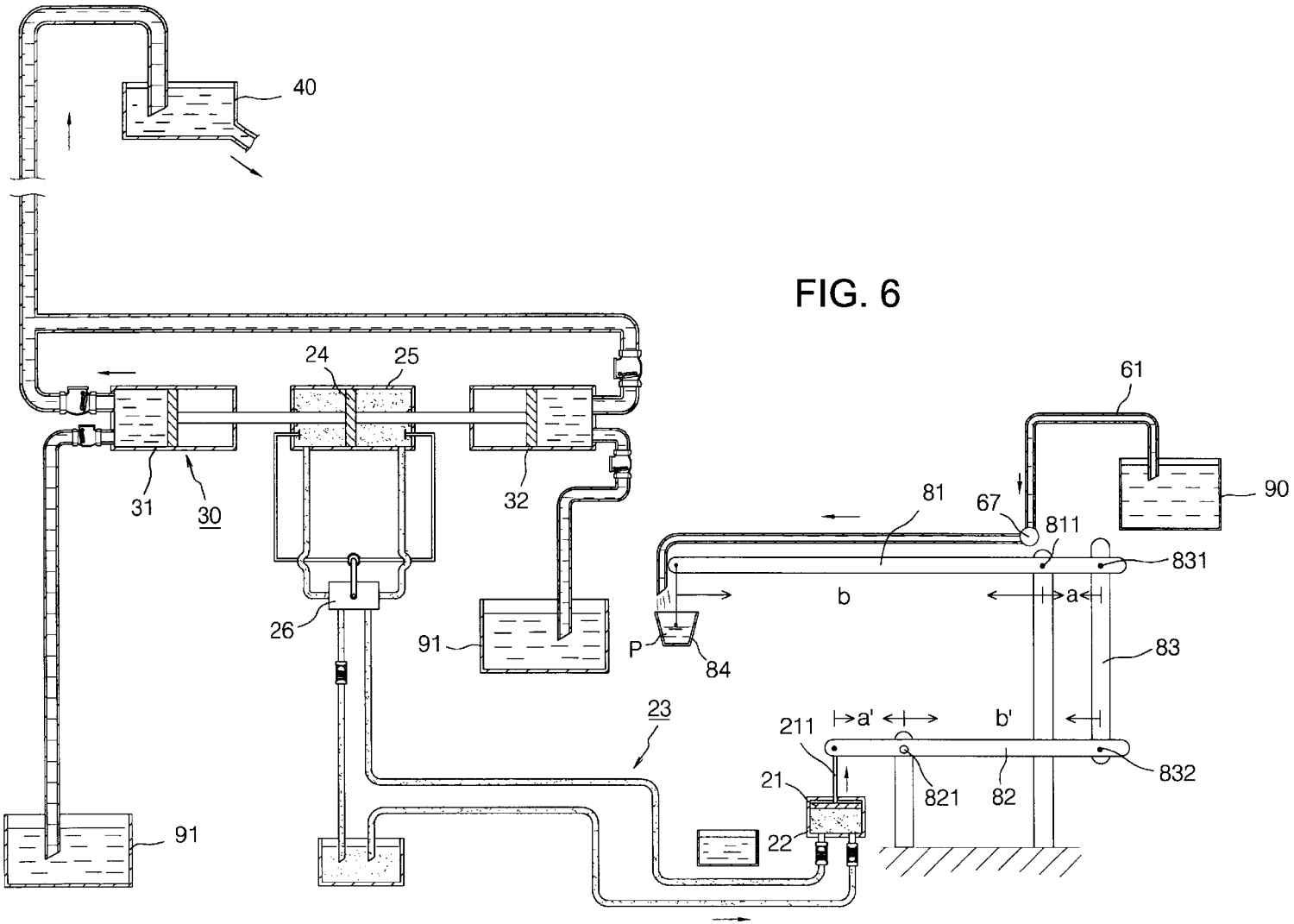
FIG. 6 is a schematic view of a water powered pumping system in accordance with a second embodiment of the present invention.
Figure 7:
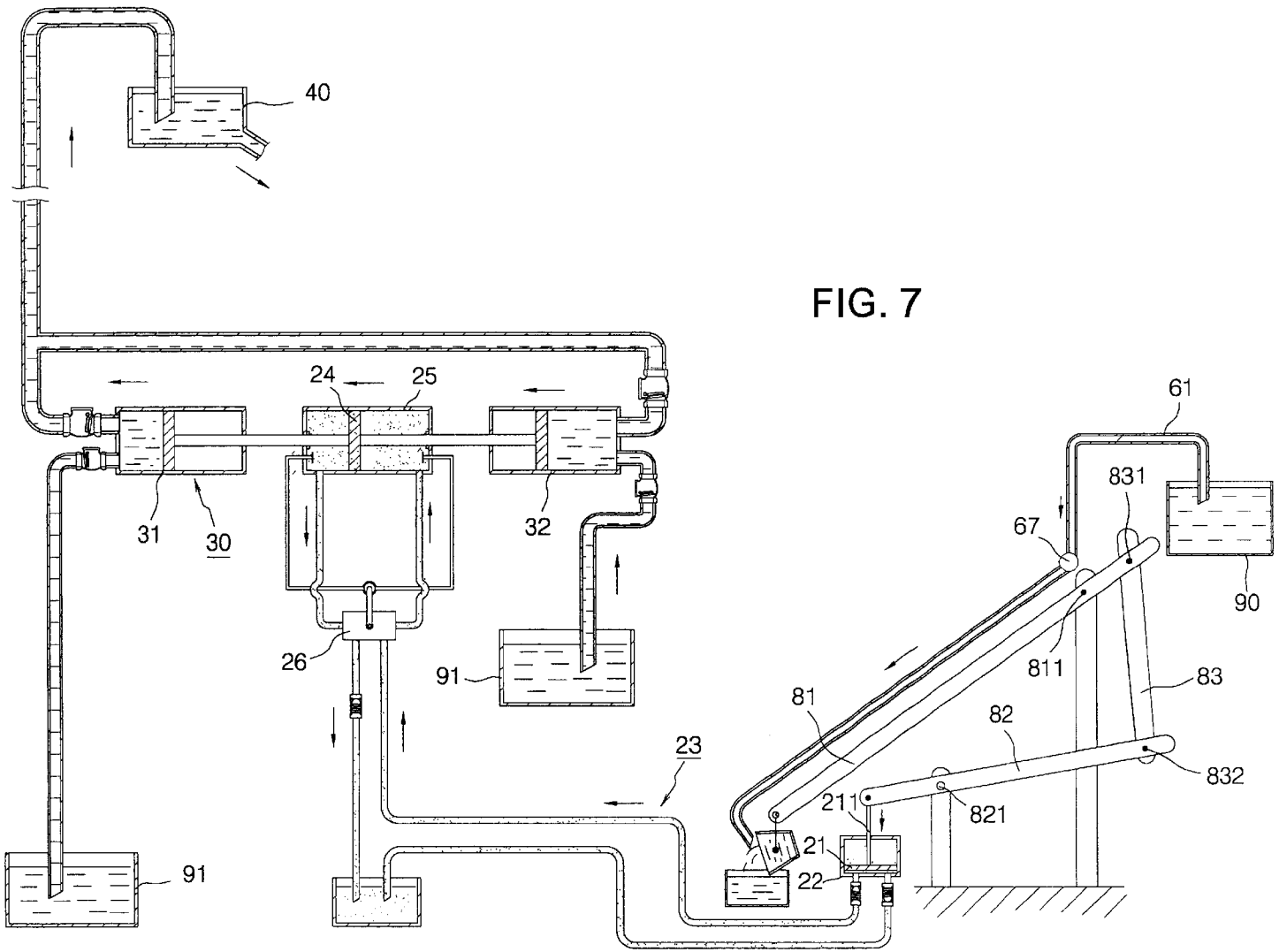
FIG. 7 is a schematic operational view of the water powered pumping system as shown in FIG. 6 in use.

Referring to FIGS. 6 and 7, a water powered pumping system in accordance with a second embodiment of the present invention may combine a composite lever with an oil pressure system so as to pump the water from a collected water source 90 at a low position to a water storage tower 40 at a high position.

The composite lever includes a first leverage 81 having a first lever fulcrum 811, a second leverage 82 having a second lever fulcrum 821, and a connecting lever 83 having a first fulcrum 831, and a second fulcrum 832, thereby forming an energy saving mechanism. A water container 84 may support a water weight (P) of about 5 kg (for example), and may be defined as the force applied point.

The distance (b) from the force applied point to the first lever fulcrum 811 is about 7 m. The distance (a) from the first lever fulcrum 811 to the first fulcrum 831 of the connecting lever 83 is about 1 m. The distance (b') from the second fulcrum 832 of the connecting lever 83 to the second lever fulcrum 821 is about 3 m. The distance (a') from the second lever fulcrum 821 to the end point of the first piston rod 211 of the first piston 21 is about 1 m. Then, the subjected force (P') of the first piston 21 is about:

$$P' = P\frac{bb'}{aa'} = 5\ \text{Kg}\frac{7\text{m}\times 3\text{m}}{1\text{m}\times 1\text{m}} = 105\ \text{Kg}$$

Thus, the composite lever may convert the water weight (P) of 5 kg into the force (P') of 105 kg, so as to push the first piston 21 to work.

As illustrated in the first embodiment, the water weight may force the composite lever to move upward and downward at different time intervals, thereby pushing a first piston 21 having a smaller area to move reciprocally in a first hydraulic cylinder 22 having a smaller volume, there pumping the hydraulic oil to flow through a hydraulic oil line 23 to push a second piston 24 having a larger area to move in a second hydraulic cylinder 25 reciprocally. Thus, this hydraulic movement mechanism has an effect of amplifying the force.

The second piston 24 may be moved in the second hydraulic cylinder 25 linearly and reciprocally by a hydraulic oil converter 26, to push a first cylinder 31 and a second cylinder 32 of the water pump 30, so as to perform a water drawing movement, including water extraction action and water pumping action, in an alternating manner, so that the water contained in the water source 91 may be conveyed into the water storage tower 40 located at a higher height.

As shown in FIG. 7, in the water powered pumping system in accordance with a second embodiment of the present invention, the water contained in the collected water source 90 may be conveyed through a water guide pipe 61, and may be introduced into a water container 84 suspended on a distal end of the first leverage 81 during a determined time interval by a flow shutter 67, such as a ball valve. The water weight may force the distal end of the first leverage 81 to move downward until the water contained in the water container 84 is poured outward. Then, the distal end of the first leverage 81 may be moved upward to return to its original position, thereby pushing the first piston 21 to move in the first hydraulic cylinder 22 reciprocally.

When the distal end of the first leverage 81 is moved downward, the inclined first leverage 81 may drive the valve rod of the flow shutter 67, such as a ball valve, to rotate through a determined angle to close the water path directed toward the water container 84. Similarly, when the distal end of the first leverage 81 is moved upward to return to its original position, the horizontal first leverage 81 may drive the valve rod of the flow shutter 67, such as a ball valve, to rotate to its original position to open the water path directed toward the water container 84 until the water container 84 is filled with water. The above-mentioned procedure may be repeated, so that the first leverage 81 may be moved upward or downward at different time intervals.

Accordingly, the water powered pumping system in accordance with the present invention has the following advantages.

1. The water powered pumping system is capable of conveying a water flow from a location at a lower level to any location at a higher level by using a natural power, thereby facilitating the user at a remote region using the water for purposes, such as irrigation or the like.

2. The water powered pumping system may guide the water in any collected water source into the water container of a lever, and may use the water weight as a power source, to pump the water contained in any water source to the water storage tower, without having to use the electric power, the petroleum, the gas or the like, so as to replace the conventional motorized or gas pump, thereby saving the energy, and thereby preventing incurring any pollution.

3. The water powered pumping system has a simple construction, thereby facilitating maintenance of the operator.

4. The water powered pumping system may be made easily and conveniently, thereby decreasing the cost of fabrication.

5. The water powered pumping system may be operated easily and conveniently, thereby facilitating the user using it.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A water powered pumping system, comprising:

a leverage, connected to a water source and moving upward and downward by using a water weight to produce a lever movement;

a hydraulic pump, pushed by the leverage to move reciprocally; and a water pump, pushed by the hydraulic pump to perform a water drawing movement, for drawing the water contained in the water source and conveying the water into a water storage tower.

2. The water powered pumping system in accordance with claim 1, wherein the water contained in the water source is conveyed through a water guide pipe, and is respectively introduced into a first water container and a second water container suspended on two ends of the leverage during a determined time interval by a flow divider, so that the water weight can force the two ends of the leverage to move upward and downward at different time intervals.

3. The water powered pumping system in accordance with claim 1, wherein the hydraulic pump includes a first piston having a smaller area that is pushed by the leverage to move reciprocally in a first hydraulic cylinder having a smaller volume, thereby pumping a hydraulic oil to flow through a hydraulic oil line to push a second piston having a larger area to move reciprocally in a second hydraulic cylinder having a larger volume.

4. The water powered pumping system in accordance with claim 3, further comprising a hydraulic oil converter for moving the second piston in the second hydraulic cylinder linearly and reciprocally, to push the water pump, so as to perform a water drawing movement, wherein the hydraulic oil converter includes:

a shaft center turning rod formed with a first return hole and a second return hole;

a U-shaped rocking rod mounted on the two ends of shaft center turning rod for forcing the shaft center turning rod to reciprocally rotate in a determined angle; and an inverted U-shaped push rod connected with the rocking rod for moving the rocking rod synchronously, the inverted U-shaped push rod having two ends respectively extended into the second hydraulic cylinder, so that the inverted U-shaped push rod is pushed by the second piston when the second piston touches one of the two ends of the inverted U-shaped push rod, to move the rocking rod which forces the shaft center turning rod to rotate through a determined angle, thereby communicating a hydraulic oil enter pipe with the first return hole or the second return hole of the shaft center turning rod, thereby changing the conveying direction of the hydraulic oil.

5. The water powered pumping system in accordance with claim 1, wherein the leverage is a composite lever including:

a first leverage connected to a water source and moving upward and downward by using a water weight to produce a lever movement;

a second leverage, for pushing the hydraulic pump to move reciprocally; and a connecting lever for connecting the first leverage and the second leverage.

6. The water powered pumping system in accordance with claim 5, wherein the water contained in the water source is conveyed through a water guide pipe, and is introduced into a water container suspended on a distal end of the first leverage during a determined time interval by a flow shutter.

* * * * *